US008505328B2

(12) United States Patent
Horst et al.

(10) Patent No.: US 8,505,328 B2
(45) Date of Patent: Aug. 13, 2013

(54) MULTIPLE UTILITY RIBBON CABLE

(75) Inventors: Gale R. Horst, Watervliet, MI (US); Douglas D. Leclear, Benton Harbor, MI (US); Karen J. Querfurth, Coloma, MI (US); Ameresh B. Viswanathan, Saint Joseph, MI (US); Ronald L. Voglewede, Saint Joseph, MI (US); Michele E. Wilcox, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1119 days.

(21) Appl. No.: 12/469,968

(22) Filed: May 21, 2009

(65) Prior Publication Data

US 2010/0293987 A1 Nov. 25, 2010

(51) Int. Cl.
*F25D 11/00* (2006.01)

(52) U.S. Cl.
USPC ..... 62/440

(58) Field of Classification Search
USPC ..... 62/389, 440, 449, 448
See application file for complete search history.

(56) References Cited

U.S. PATENT DOCUMENTS

| | | | | |
|---|---|---|---|---|
| 3,024,621 | A | 3/1962 | Parker | |
| 6,367,510 | B1 | 4/2002 | Carlson | |
| 7,146,821 | B2 | 12/2006 | McKibbin | |
| 7,501,594 | B2 * | 3/2009 | Fulton et al. | 200/51 R |
| 7,810,345 | B2 * | 10/2010 | Nebbia et al. | 62/338 |
| 2005/0230228 | A1 | 10/2005 | Smith et al. | |
| 2007/0102447 | A1 | 5/2007 | Fulton et al. | |

* cited by examiner

*Primary Examiner* — Melvin Jones
(74) *Attorney, Agent, or Firm* — Kirk W. Goodwin; Daniel M. Blakeslee

(57) ABSTRACT

An elongated polymeric ribbon is mounted to the cabinet of a refrigerator/freezer or the door and at least one electrical conductor is integrally formed in the ribbon, which also integrally includes at least one fluid conduit. In one embodiment, the ribbon is mounted in association with an elongated spine, such that a module can be mounted anywhere along the spine and coupled to the polymeric ribbon for receiving operating utilities therefrom. This system provides the manufacturer with the capability of positioning a module requiring operating utilities at any desired location within a refrigerator/freezer cabinet and/or on the doors of the refrigerator/freezer. The ribbon connector is accessed by connections which allow dealers to customize refrigerators for individual consumers.

38 Claims, 9 Drawing Sheets

MULTIPLE UTILITY RIBBON CABLE

BACKGROUND OF THE INVENTION

The present invention relates to a system for providing electrical and fluid utilities to a cabinet, such as a refrigerator cabinet, in which a single extruded or molded ribbon-like cable integrally includes both electrical and fluid conduits to which modules can be coupled for receiving utilities therefrom.

New refrigeration designs are incorporating flexibility for the consumer in selecting different features. Some of the features include, for example, module components such as disclosed in patent application Ser. No. 12/402,559 entitled Vacuum Food Preservation System; Ser. No. 12/402,747 entitled Chilling and Thawing Modular Appliance System; and Ser. No. 12/402,731 entitled Modular Door Mounted Climate Controlled Medicine Compartment, all of which were filed on Mar. 12, 2009, which require utilities in the form of electrical operating power, data signals, fluids in either liquid or gaseous form, or the like, for their operation. The disclosures of these applications are incorporated herein by reference. U.S. patent application Ser. No. 12/402,644, filed Mar. 12, 2009, entitled Refrigerator With Module Receiving Conduits discloses a modular system in which utilities are supplied by separate fluid and electrical conduits which are molded into the refrigerator cabinet and which have specific outlets at discreet locations to allow modules to be installed therein at incremental locations where such outlets exist. The disclosure of this application is incorporated herein by reference.

A mounting system for providing a continuous mounting spine for selective positioning modules anywhere along the spine is disclosed in U.S. patent application Ser. No. 12/469,915, filed May 21, 2009, entitled Refrigerator Module Mounting System, which is assigned to the present assignee, and the disclosure of which is incorporated herein by reference.

In order to provide even greater flexibility for the mounting of modules requiring operating utilities, it would be desirable to allow the manufacturer or dealer to provide the consumer with the flexibility of selecting a module location at any desired position within the interior cabinet of a refrigerator/freezer.

SUMMARY OF THE INVENTION

The system of one embodiment of the present invention provides such flexibility by incorporating an elongated polymeric ribbon, which is mounted to the cabinet of a refrigerator/freezer or the doors thereof and at least one electrical conductor integrally formed in the ribbon, which also integrally includes at least one fluid conduit. Modules can then be mounted to connect to the ribbon at any desired location along the length of the ribbon.

In another embodiment of the invention, the refrigerator/freezer cabinet includes an elongated spine supported within the cabinet and including a continuous mounting channel and an elongated polymeric ribbon mounted in association with the spine and integrally including at least one electrical conductor and at least one fluid conduit, such that a module can be physically mounted anywhere along the spine and coupled to the polymeric ribbon for receiving operating utilities therefrom.

In one embodiment interface connectors are provided which engage the ribbon such that modules can plug into the connectors for installation at consumer selected locations prior to delivery of the refrigerator/freezer to the consumer. Such systems, thereby, provides the manufacturer, a distribution center, or an installer with the capability of positioning a module requiring operating utilities at any desired location within a refrigerator/freezer cabinet and/or on the doors of the refrigerator/freezer.

These and other features, objects and advantages of the present invention will become apparent to those skilled in the art upon reading the following description thereof together with reference to the accompanying drawings.

DETAILED DESCRIPTION OF THE PREFERRED EMBODIMENT

Figure 1:
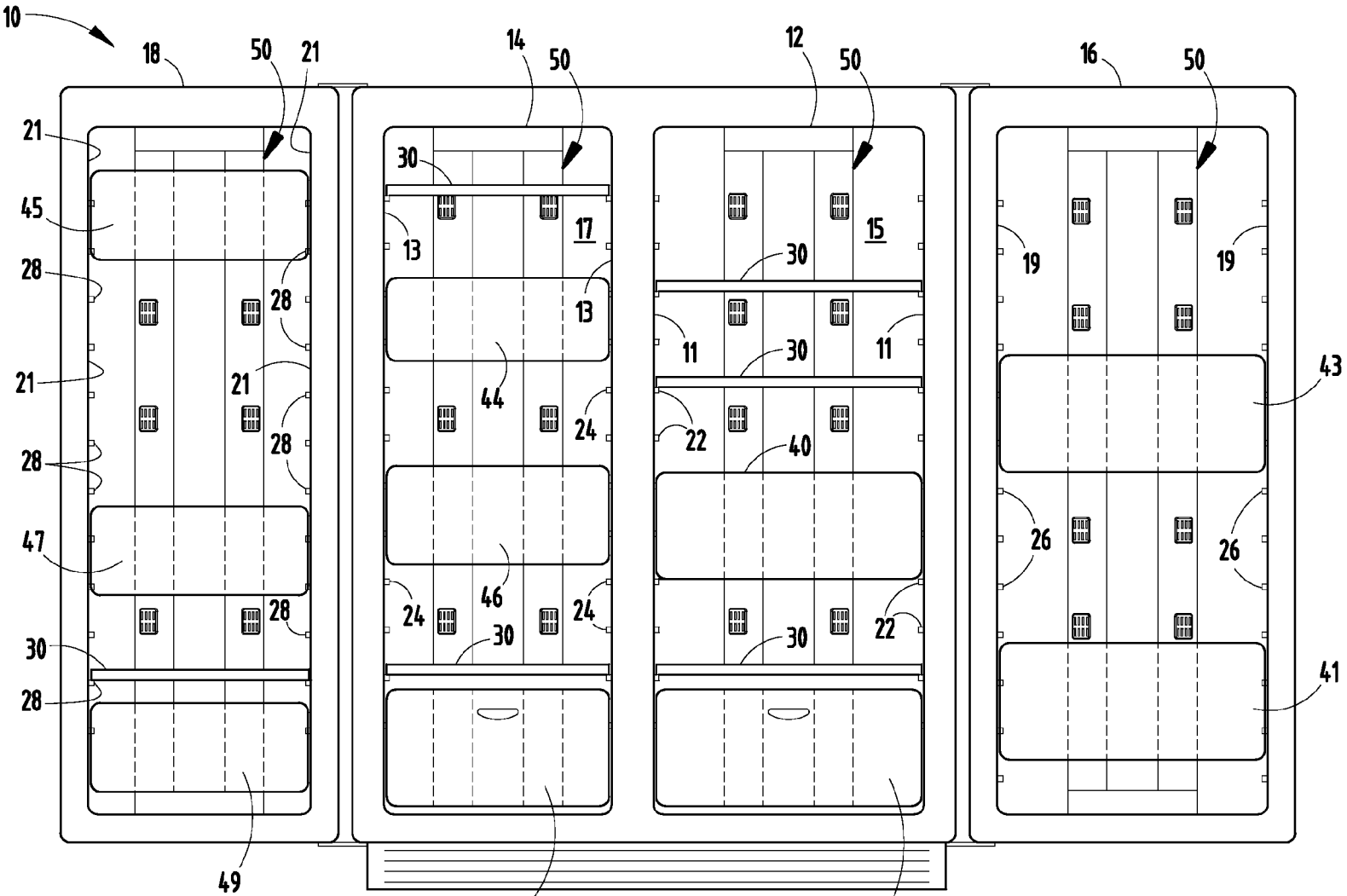
FIG. 1 is front elevational view of a refrigerator/freezer embodying the present invention.

Referring initially to FIG. 1, there is shown a refrigerator/freezer 10 embodying the present invention, which includes a side-by-side refrigerator cabinet 12 and freezer cabinet 14. Each of the cabinets 12 and 14 include side walls 11 and 13, respectively, and a rear wall 15 and 17, respectively. Refrigerator 10 also includes a closure door 16 for the refrigerator cabinet 12, which is conventionally hinged to cabinet 12, and a freezer closure door 18, also conventionally hinged to the freezer cabinet 14. Both doors 16 and 18 include suitable seals for providing an airtight, thermally insulated sealed connection between the doors and the respective cabinets. Each of the doors 16 and 18 also include side edges 19 and 21, respectively.

Refrigerator 10 is adapted to receive a variety of shelves and modules, as described below, at different incrementally located positions defined by, in the embodiment shown in FIG. 1, a plurality of vertically spaced shelf/module supports 22 extending inwardly from the sidewalls of the refrigerator cabinet 12 and similar supports 24 for the freezer compartment 14. The edges of doors 16 and 18 include similar vertically spaced shelf supports 26 and 28. respectively. The shelf and module extend in parallel relationship to one another and extend from the front of the cabinets to the rear walls.

Alternatively, rear walls 15 and 17 of cabinets 12 and 14, respectively, may include vertically extending tracks with vertically spaced slots for receiving mounting tabs on the shelves and modules for attaching them in a cantilevered fashion to the cabinets at selected incrementally located locations. Doors 16 and 18 may likewise include a pair of spaced-apart tracks with notches for receiving tabs and the bins or modules mounted within the doors. Such mechanical mounting structure is conventional.

Figure 4:
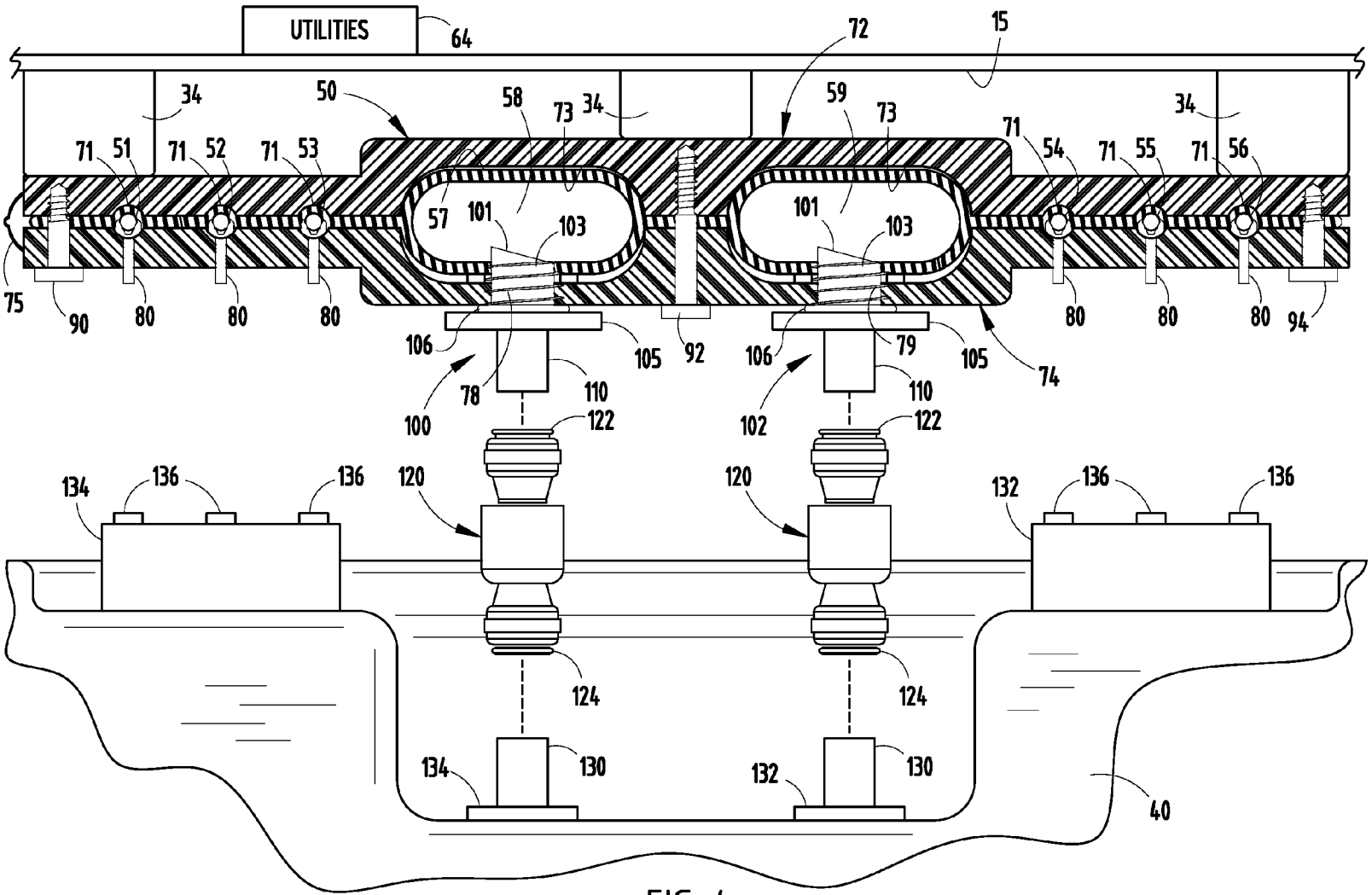
FIG. 4 is an enlarged exploded horizontal cross-sectional view of the ribbon cable showing a module associated therewith.

Mounted in spaced relationship by spacers 34 (FIGS. 4-5) to the rear walls 15 and 17 of the refrigerator/freezer are generally vertically extending elongated ribbon cables 50 embodying the present invention. The cables 50 integrally include, as described below, both at least one electrical conductor for providing operating power to modules coupled thereto as well as a conduit for supplying fluid to such modules. Such fluids include, for example, water, coolant fluids such as a glycol or alcohol water mixture, or chilled air. The electrical conductors and fluid conduits are horizontally spaced from one another within the ribbon cable 50 with the electrical conductors capable of providing either operating power, data, or control signals in analog or digital format to modules mounted within the refrigerator or freezer compartments and coupled to the ribbon cable, as described below. Doors 16 and 18 likewise may include ribbon cables 50 of the same construction and which extend vertically, typically centrally within the doors to provide operating power and/or fluids to modules within the doors.

The refrigerator cabinet 12 will typically include numerous shelves 30 at spaced locations within the cabinet and modules, such as modules 40 and 42, which are electrically and fluidly coupled to ribbon cable 50 for receiving power and/or fluids therefrom. Similarly, the freezer cabinet 14 includes shelves 30 which are adjustable within the shelf supports 24 for supporting frozen goods thereon and modules 44, 46, and 48, which are coupled to the utility supplying ribbon 50 in freezer cabinet 14. The doors 16 and 18 likewise may include modules 43, and 45 and 47 respectively. The doors may also include conventional several storage bins such as bins 41 and 49 in the refrigerator door 16 and freezer door 18, respectively. The modules may include, for example, an ice maker, water dispensing unit, or the type of module disclosed in the above-identified pending patent applications or any other type of module which require operating power, data, cooling fluids, or other utility available from the ribbon cable 50. Having briefly described the overall concept of providing an umbilical-like ribbon cable for supplying utilities to plug-in modules, a description of the ribbon cable, which integrally include electrical and fluid conduits, is presented with respect to FIGS. 2-5.

Figure 2:
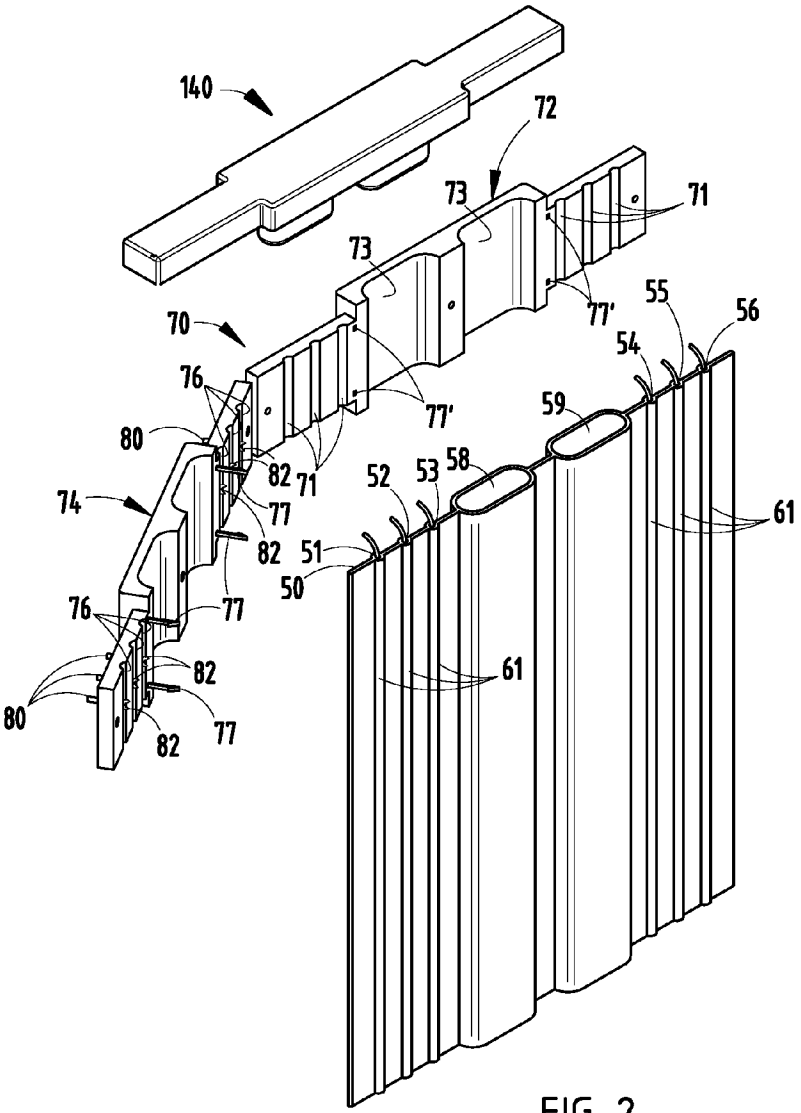
FIG. 2 is a fragmentary perspective exploded view of the ribbon cable of the present invention, shown with a coupler for coupling a module to the ribbon cable and an end cap.

Ribbon cable 50 is mounted to a wall of a refrigerator, typically the rear wall, by spacers 34 (FIG. 4) which are located at vertically and horizontally spaced intervals as necessary to support the ribbon and allow accessibility for coupling the connectors 70 to the ribbon as described below. The spacers may be bonded to the ribbon with suitable adhesive material and likewise to the surface of wall 15, or if necessary, suitable fasteners can be extended through the ribbon in the areas through which fasteners 90, 92, and 94 (FIG. 4) extend. The ribbons 50 extend vertically the height of the cabinets 12, 14, and doors 16, 18. The ribbon cable 50 is manufactured of a polymeric material and is integrally formed to integrally include electrical conductors, such as 18 to 20 gauge conductors 51-56 (FIG. 2). The conductors 51-56 can be conventional insulated wires which may include an insulator around the conductive elements and are co-extruded with the ribbon cable 50 together with fluid conduits 58 and 59. The ribbon 50 can be extruded utilizing a conventional co-extruding process to integrate conductors 51-56 within the cable 50 as well as the fluid transmitting conduits 58 and 59. Conduits 52 and 59 are of a size sufficient to provide the desired flow of fluids and can be from about 6 mils to about 19 mils in their major axis. Alternatively the ribbon can be injection molded in a suitable molding apparatus which holds the conductors in place during the molding process. The materials employed for the body of the ribbon cable 50 may include any one of polyethylene, polyvinyl chloride, polypropylene, polyurethane, and/or polystyrene to provide the desired strength and temperature resistant properties as well as insulating properties for the conductors and fluids handled by the cable 50.

Figure 3:
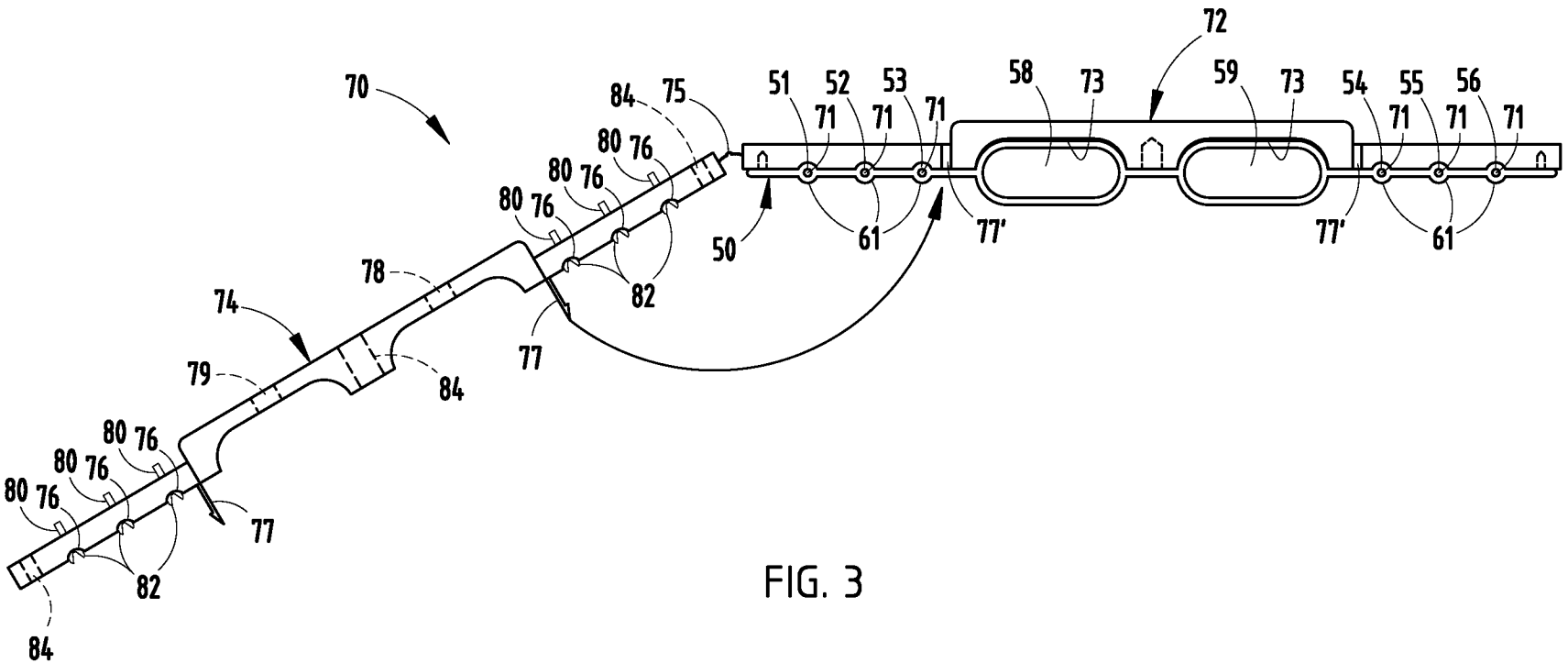
FIG. 3 is a top plan view of the connector and a ribbon cable during assembly.

Access to the conductors 51-56 and fluid conduits 58, 59 is provided by connectors 70, such as shown in FIGS. 2-5 wherever along the ribbon that a utility needs to be introduced to the ribbon or where a module is to be coupled for utilizing a utility available from the ribbon. One such connector will be installed along the rear wall 57 of the ribbon and connect the ribbon to a source of utilities (shown schematically at 64 in FIG. 4) in a manner similar to the coupling of the ribbon to a module. Each of the connectors 70 includes a rear section 72 having semicircular recesses 71 at spaced locations for receiving the semicircular sections 61 on the rear surface 57 of cable 50. Rear section 72 also includes semi-oval recesses 73 for receiving the oval half profile of the conduits 58 and 59, as shown in FIGS. 2-3. Connector 70 also includes a front section 74 hinged to rear section 72 by a polymeric living hinge 75. Section 74 includes conduit-piercing pins 80 extending through the connector 70 in the semi circular conductor receiving recesses 76. Pins 80 are made of a conductive material and include knife edges 82 for piercing the ribbon 50 for engaging and circumscribing conductors 51-56 for making electrical contact therewith. The outwardly extending pins on the opposite side of edges 82 are engaged by sockets, such as sockets 132, 134 (FIG. 4), coupled to a module, such as module 40, for supplying operating power thereto.

Figure 5:
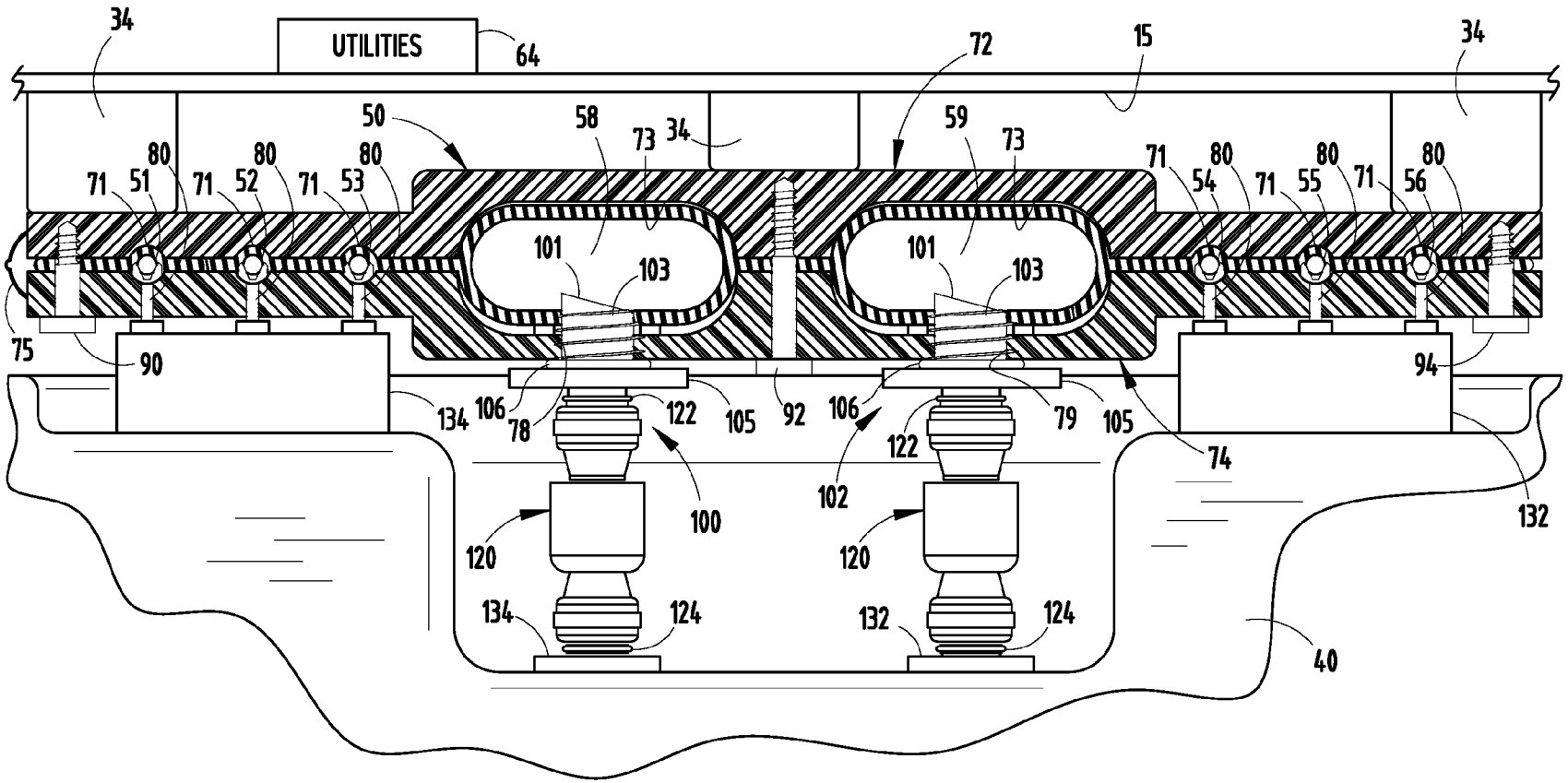
FIG. 5 is a cross-sectional view of the ribbon cable and module of FIG. 4 once the module is attached thereto.

The front section 74 of connector 70 is secured to rear section 72 initially by pairs of locking tabs 77 which fit within slots 77' to initially hold the connector 70 in place at a selected location along the continuously selectable length of ribbon cable 50. Once the initial position has been established and the clamp-like connector 70 has been positioned on ribbon cable 50, front section 74 is firmly secured to rear section 72 by means of a plurality of self threading fasteners, such as threaded screws 90, 92, and 94 (FIGS. 4-5) which extend through apertures 84 in section 74. In order to provide fluid communication to the conduits 58 and 59, knife edge piercing threaded fittings 100 and 102 are provided and self-threaded into the relatively thin walls of conduits 58 and 59, as best seen in FIG. 5. For such purpose, each of the fittings 100 include a sharp knife edge end 101 and threads 103 of sufficient length to extend through apertures 78 and 79 in front section 74 of the connector 70. Each of the fittings 100 and 102 also include a backing flange 105 and sealing O-ring 106, which assures a fluid-tight seal between the fittings 100, 102 and the conduits 58, 59. Each of the fittings integrally include a nipple 110 to receive a quick disconnect fitting 120 in sealable relationship thereto. Fitting 120 can be a fitting such as manufactured by the John Guess Company, such as Model No. 5/16SCV, or similar coupling. Fitting 120 has an end 122 for receiving nipple 110 and an opposite end 124 which sealably receives the nipple 130 extending from module 40 to supply the fluid, such as a coolant, to module 40 from one of the conduits 58 or 59. A similar fluid coupling arrangement is provided for the other of the conduits as required by a given module.

Module 40 also includes female sockets 132 and 134 with pin-receiving contacts 136 for engaging electrical contact pins 80 extending from the ribbon cable connector 70. The conductors and utilities through the conduits 58 and 59 can be supplied through a connector 70 coupled to the rear surface of the ribbon in a manner similar to that shown in FIG. 4 but coupled to the utilities at a location spaced from a connector for a module. A sealing end cap 140, such as shown in FIG. 2, which extends over and sealably engages the opposite ends of ribbon cable 50. FIG. 5 illustrates the coupling of one of the modules 40 to the ribbon 50, it being understood that the other modules in the cabinets and doors are similarly coupled to the ribbon as is the ribbon to the supply of utilities.

Figure 6:
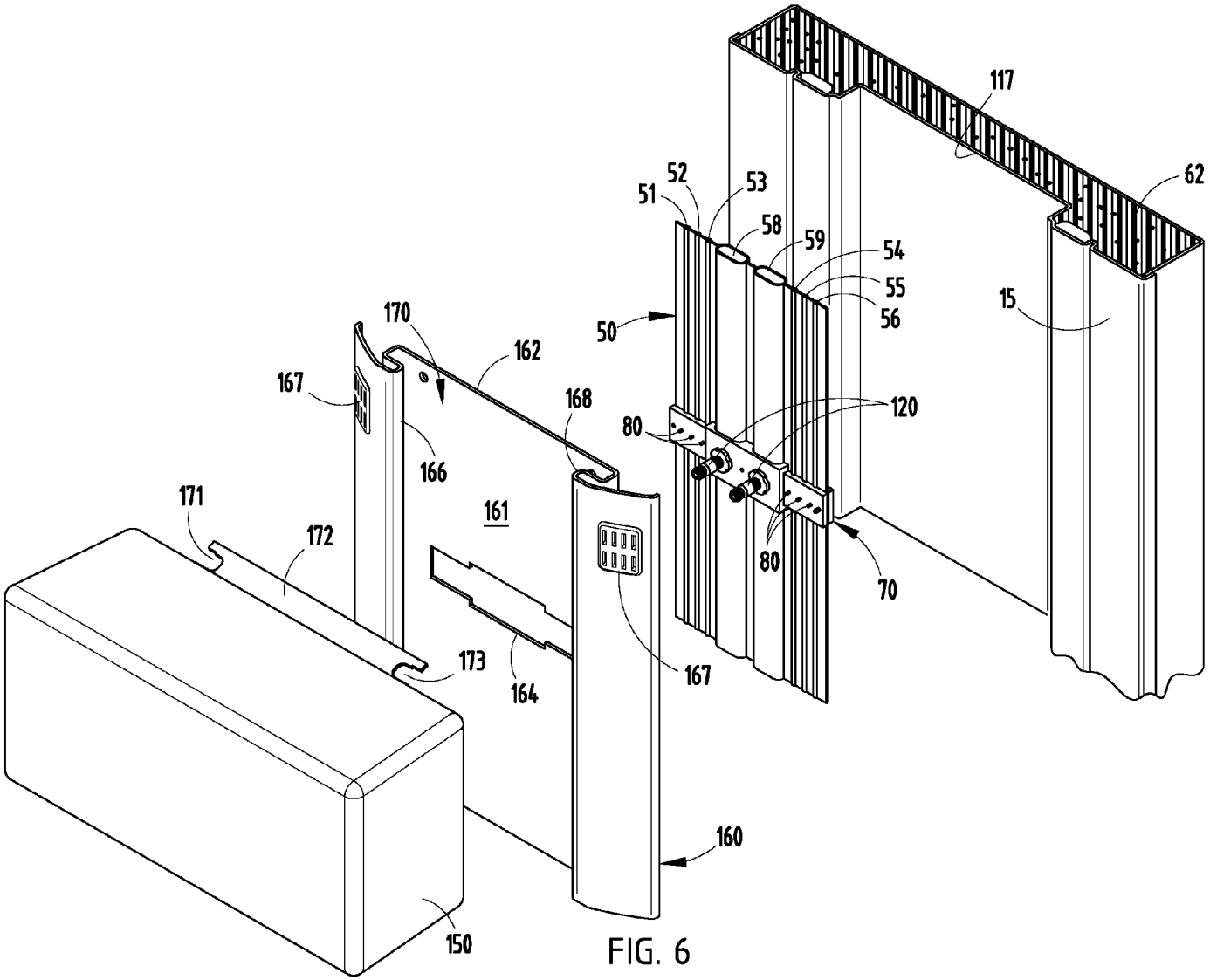
FIG. 6 is an exploded perspective view of the combination of the ribbon cable of the present invention and a continuous mounting spine.

In another embodiment of the invention, a module, such as module 150 shown in FIG. 6, is coupled to the rear wall 17 of a cabinet, such as a refrigerator cabinet 12 or freezer cabinet 14, by means of a structural spine 160, which can be of the type described in the above-identified copending patent application Ser. No. 12/469,915, filed on May 21, 2009, entitled Refrigerator Module Mounting System. Associated with this installation is the same ribbon cable 50 as in the embodiment described above and is mounted within a recess 117 in rear wall 17 by spacers, such as spacers 34 described above. Associated with spine 160 is a channel 170 for receiving a mounting flange 172 extending from the rear wall of module 150. The spine 160 includes a rear wall 162 having a cutout 164 to allow the connector 70, mounted to ribbon 50 as described above, to extend therethrough and permit the coupling elements, including pins 80 and fitting 120 to be accessed by module 150. Spine 160 also includes inwardly projecting lips 166 and 168, which fit within generally U-shaped slots 171 and 173 of flange 172 for physically mounting the module, such as module 150, to the spine 160. Spine 160 may include additional ducts 165 and spaced outlets 167 to provide cooling for the interior of cabinets 12 and/or 14, in addition to the utilities supplied to module 150 from ribbon 50.

Figure 7:
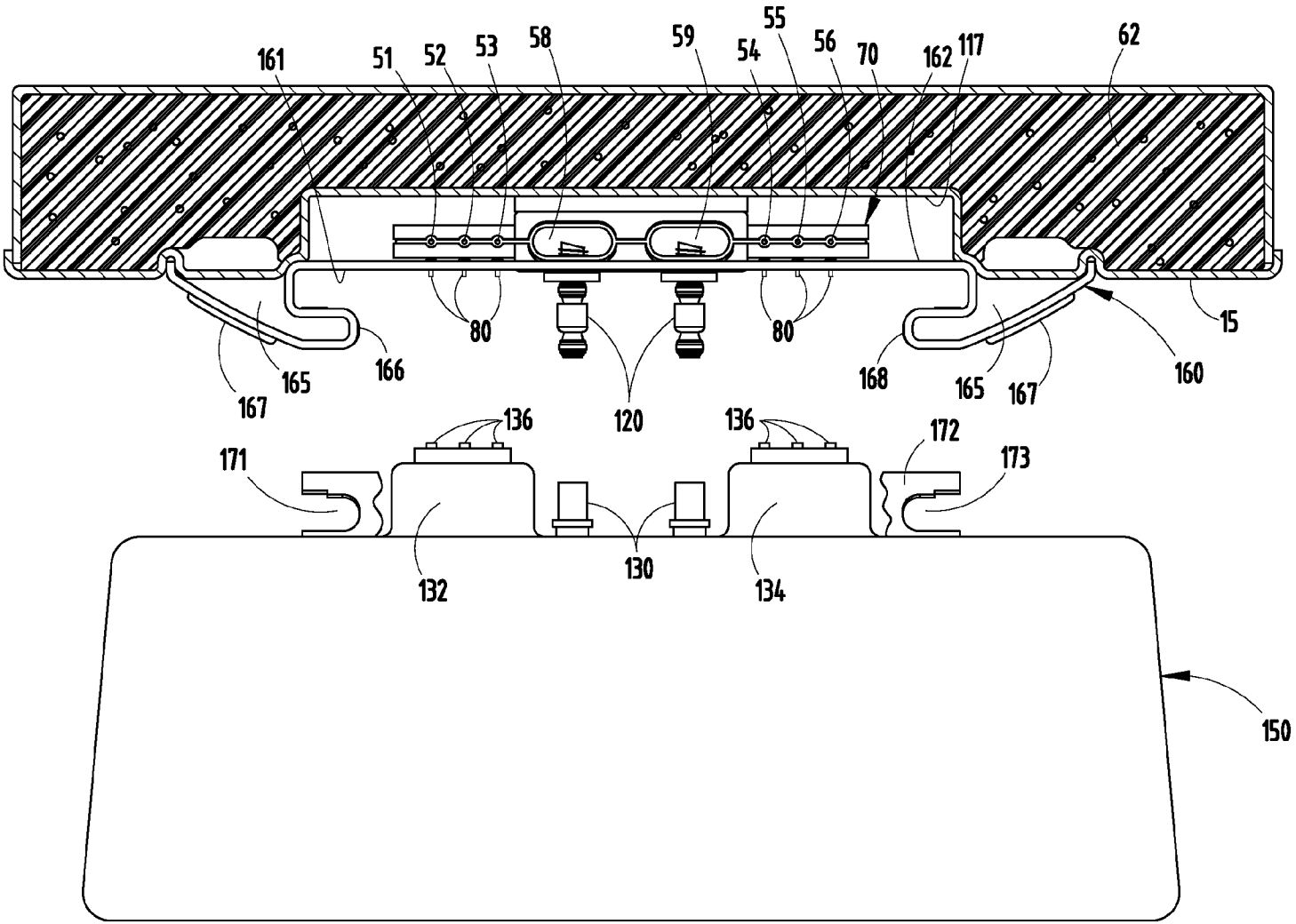
FIG. 7 is a horizontal fragmentary cross-sectional view of the ribbon cable and spine of FIG. 6 showing a module for coupling to the ribbon and spine.
Figure 8:
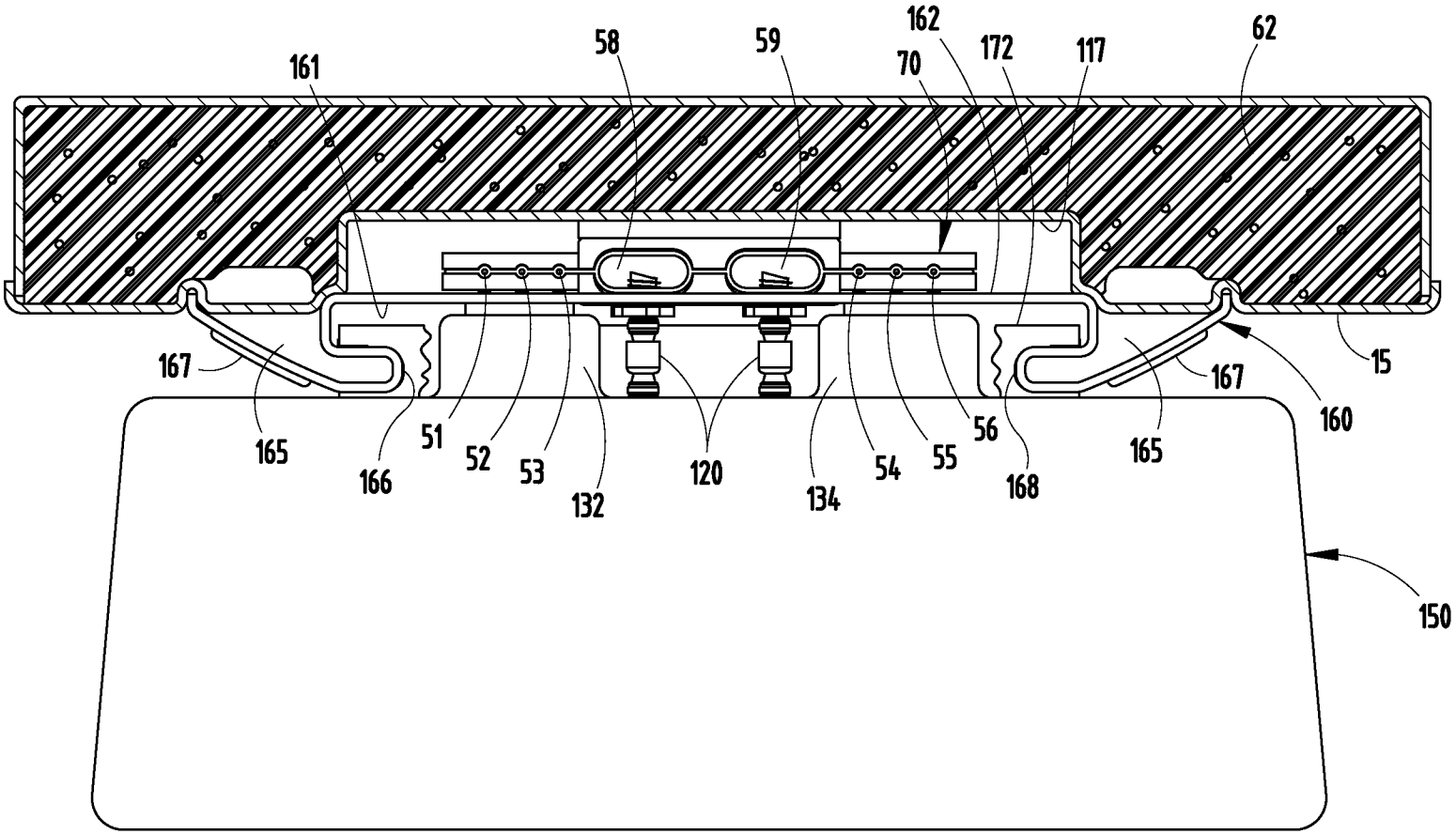
FIG. 8 is a horizontal fragmentary cross-sectional view of the ribbon cable and spine of FIG. 7 showing the module coupled to the ribbon and spine.
Figure 10:
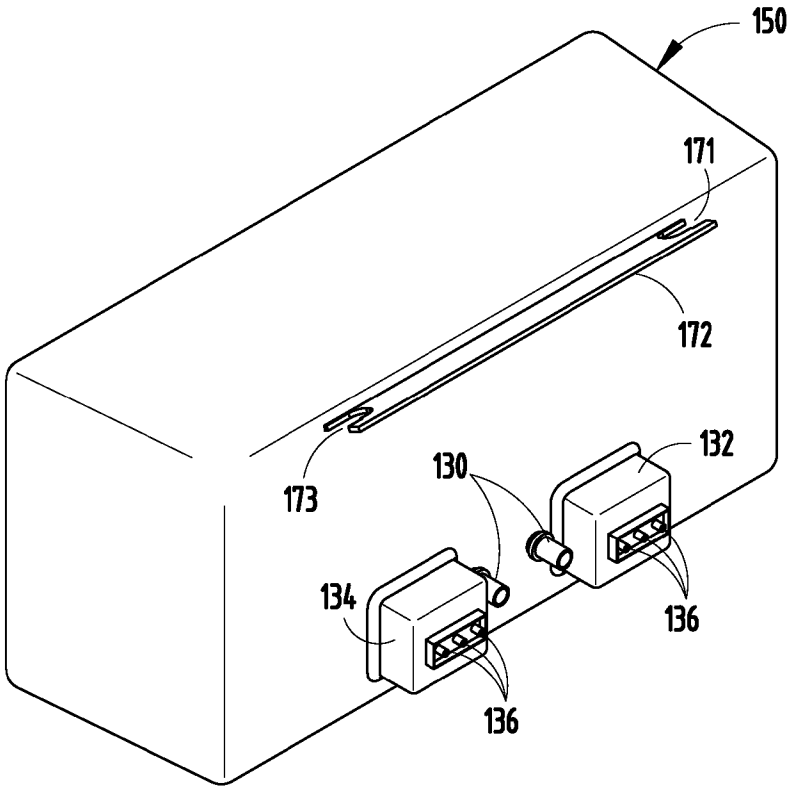
FIG. 10 is a rear elevational view of the module shown in FIGS. 4-9.
Figure 9:
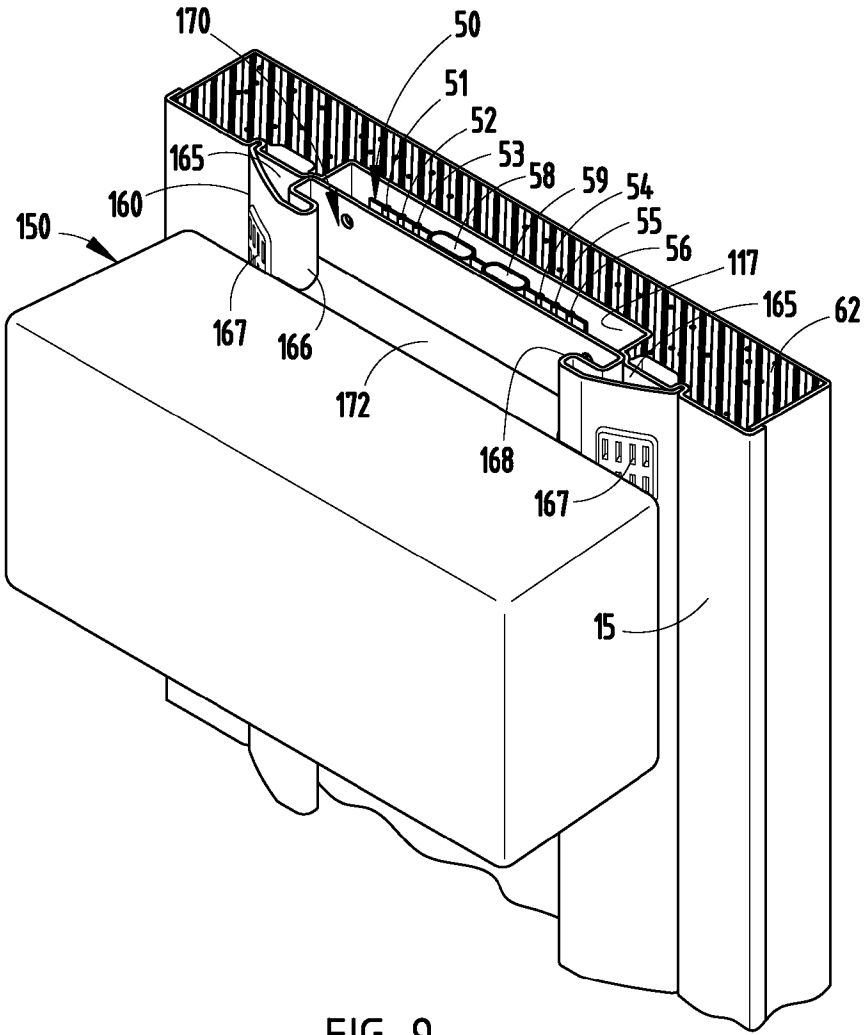
FIG. 9 is a fragmentary perspective view of the installed module shown in FIG. 8.

As seen in FIGS. 7 and 8, module 150 is coupled to the connector pins 80 and fittings 120 through the utilization of the same type of connectors as employed in the previous embodiment, namely, connectors 132 and 134. Nipples 130 and contacts 136 couple to connectors 120 and pins 80, respectively. Module 150 is mounted within the channel 170 by rotating the module to allow flange 172 to fit within and engage channel 170 and then move module 150 to a position aligning sockets 132 and 134 with apertures 164 and connector 70. The module 150 is then rotated against the surface 161 of spine 160, completing the connection to connector 70 as seen in FIGS. 8 and 9.

In FIGS. 6-10, the benefits of the mechanical spine mounting system allowing infinite adjustability of the vertical position of a module (or bin) is possible, together with the benefits of the use of a ribbon 50 supplying utilities at any desired location. This combination provides the benefits of both a mechanically adjustable spine and the adjustable access to utilities for a module.

It will become apparent to those skilled in the art that various modifications to the preferred embodiments of the invention as described herein can be made without departing from the spirit or scope of the invention as defined by the appended claims.

The invention claimed is:

1. A ribbon connector for supplying utilities to a cabinet comprising:

an elongated polymeric ribbon body mounted to the cabinet; and at least one electrical conductor integrally formed in said body, and wherein said body integrally includes at least one fluid conduit, and wherein said body is extruded and said conductor is co-extruded within said body.

2. The ribbon connector as defined in claim 1 wherein said body is made of one of polyethylene, polyvinylchloride, polypropylene, polyurethane, and polystyrene.

3. A refrigerated cabinet comprising:

top, bottom, rear and side walls and an access door;

an elongated polymeric body secured to at least one of said walls or door, said polymeric body including at least one electrical conductor integrally formed in said body, and wherein said body integrally includes at least one fluid conduit; and at least one module secured to said cabinet and including a connector coupled to said polymeric body and communicating with said at least one electrical conductor or fluid conduit for providing power or data to said module and a fluid to said module.

4. The refrigerated cabinet as defined in claim 3 wherein said polymeric body is extruded and said conductor is co-extruded with said body.

5. The refrigerated cabinet as defined in claim 4 wherein said fluid conduit is coupled to a supply of cold air for supplying cold air to said module.

6. The refrigerated cabinet as defined in claim 4 wherein said fluid conduit is coupled to a supply of water for supplying water to said module.

7. The refrigerated cabinet as defined in claim 3 wherein said body is extruded of one of polyethylene, polyvinylchloride, polypropylene, polyurethane, and polystyrene.

8. A cabinet for housing one or more modules requiring electrical power or data and a fluid, said cabinet comprising:

rear and side walls and an access door;

an elongated polymeric ribbon secured to one of said walls or door, said ribbon including a plurality of electrical conductors integrally formed therein, and wherein said ribbon integrally includes at least one fluid conduit, a mounting structure extending along at least one of said walls; and at least one module secured to said mounting structure and including a connector coupled to said ribbon and communicating with said electrical conductors or fluid conduit for providing power or data to said module and a fluid to said module.

9. The cabinet as defined in claim 8 wherein said ribbon is extruded.

10. The cabinet as defined in claim 9 wherein said ribbon is made of one of polyethylene, polyvinylchloride, polypropylene, polyurethane, and polystyrene.

11. A refrigerated compartment comprising:

rear and side walls and an access door;

an elongated ribbon-like body coupled to at least one of said walls or door, said body including at least one electrical conductor and at least one fluid conduit integrally formed in said body: and at least one module positioned within said compartment including a connector coupled to said body and communicating with said at least one electrical conductor or fluid conduit for providing electrical power or data and a fluid to said module.

12. The refrigerated compartment as defined in claim 11 wherein said body is made of a polymeric material.

13. The refrigerated compartment as defined in claim 12 wherein said body is extruded and said conductor is co-extruded with said body.

14. The refrigerated compartment as defined in claim 13 wherein said fluid conduit is coupled to a supply of cold air for supplying cold air to said module.

15. The refrigerated compartment as defined in claim 13 wherein said fluid conduit is coupled to a supply of water for supplying water to said module.

16. The refrigerated compartment as defined in claim 11 wherein said body is extruded of one of polyethylene, polyvinylchloride, polypropylene, polyurethane, and polystyrene.

17. The refrigerated compartment as defined in claim 11 wherein said ribbon-like body includes a plurality of spaced-apart electrical conductors.

18. The refrigerated compartment as defined in claim 11 wherein said ribbon-like body includes a plurality of fluid conduits.

19. A refrigerated compartment comprising:

a cabinet having rear and side walls and an access door;

an elongated spine supported within said cabinet and integrally including one of a channel or beam;

an elongated polymeric ribbon mounted to said spine and integrally including at least one electrical conductor and at least one fluid conduit; and at least one module for mounting to said spine and including the other of at least one channel and beam for mechanically attaching said module to said spine and a connector for coupling to said ribbon for receiving operating power, data, or fluids from said ribbon at a selected location along said spine.

20. The refrigerated compartment as defined in claim 19 wherein said spine includes a channel and said module includes a beam which fits within said channel for attaching said module to said cabinet.

21. The refrigerated compartment as defined in claim 20 wherein said ribbon is extruded and said conductor is co-extruded.

22. The refrigerated compartment as defined in claim 21 wherein said ribbon is made of one of polyethylene, polyvinylchloride, polypropylene, polyurethane, and polystyrene.

23. The refrigerated compartment as defined in claim 22 wherein said fluid conduit is coupled to a supply of cold air for supplying cold air to said module.

24. The refrigerated compartment as defined in claim 22 wherein said fluid conduit is coupled to a supply of water for supplying water to said module.

25. The refrigerated compartment as defined in claim 19 wherein said ribbon includes a plurality of spaced-apart electrical conductors.

26. The refrigerated compartment as defined in claim 19 wherein said ribbon includes a plurality of fluid conduits.

27. A refrigerator and/or freezer comprising:

a refrigerated cabinet having an access opening;

a door for selectively enclosing said access opening;

at least one elongated spine supported by at least one of said cabinet and door, said spine having a continuous mounting member;

a ribbon-like body associated with said spine and integrally including at least an electrical conductor and a fluid conduit;

at least one module for mounting to one of said cabinet and door and having a mating mounting member for coupling said module to said spine, said module further including a connector for coupling to said ribbon-like body for receiving operating power, data, or fluids at a selected location along said spine.

28. The refrigerator and/or freezer as defined in claim 27 wherein said continuous mounting member comprises a channel.

29. The refrigerator and/or freezer as defined in claim 28 wherein said mating mounting member comprises a flange which fits within said channel.

30. The refrigerator and/or freezer as defined in claim 27 wherein said ribbon is extruded and said conductor is co-extruded.

31. The refrigerator and/or freezer as defined in claim 30 wherein said ribbon is made of one of polyethylene, polyvinylchloride, and polypropylene.

32. The refrigerator and/or freezer as defined in claim 27 wherein said fluid conduit is coupled to a supply of cold air for supplying cold air to said module.

33. The refrigerator and/or freezer as defined in claim 27 wherein said fluid conduit is coupled to a supply of water for supplying water to said module.

34. The refrigerator and/or freezer as defined in claim 27 wherein said ribbon includes a plurality of spaced-apart electrical conductors.

35. The refrigerator and/or freezer as defined in claim 27 wherein said ribbon includes a plurality of fluid conduits.

36. A refrigerated compartment comprising:

a cabinet having a wall;

an elongated spine supported on said wall and including a mounting channel;

an elongated ribbon mounted to said wall and integrally including at least one electrical conductor and at least one fluid conduit; and at least one module for mounting to said spine and including a flange for mechanically attaching said module to said channel of said spine and a connector for coupling to said ribbon for receiving operating power, data, or fluids from said ribbon at a selected location along said spine.

37. The refrigerated compartment as defined in claim 36 wherein said ribbon is extruded of a polymeric material and said conductor is co-extruded.

38. The refrigerated compartment as defined in claim 37 wherein said ribbon is made of one of polyethylene, polyvinylchloride, polypropylene, polyurethane, and polystyrene.

* * * * *